US006012959A

United States Patent [19]

Blonder

[11] Patent Number: 6,012,959

[45] Date of Patent: Jan. 11, 2000

[54] THERMAL- POWERED ROCKING DEVICE

[76] Inventor: Greg E. Blonder, 112 Mountain Ave., Summit, N.J. 07901

[21] Appl. No.: 09/031,283

[22] Filed: Feb. 26, 1998

Related U.S. Application Data

[60] Provisional application No. 60/044,787, Apr. 22, 1997.

[51] Int. Cl.[7] ..... A63H 33/00

[52] U.S. Cl. ..... 446/14; 446/267; 40/406; 434/300

[58] Field of Search ..... 446/14, 267, 199, 446/491; 40/406, 409, 427; 434/276, 300, 302, 303, 315

[56] References Cited

U.S. PATENT DOCUMENTS 2,402,463 6/1946 Sullivan ..... 446/199

FOREIGN PATENT DOCUMENTS

| | | | |
|---|---|---|---|
| 451296 | 9/1948 | Canada | 446/14 |
| 73600 | 1/1952 | Denmark | 446/351 |
| 451145 | 5/1950 | Italy | 46/199 |
| 2080129 | 2/1982 | United Kingdom | 446/267 |

*Primary Examiner*—D Neal Muir

*Attorney, Agent, or Firm*—Mathews, Collins, Shepherd & Gould, P.A.

[57] ABSTRACT

In accordance with the invention, a solar rocking device comprises a pair of chambers coupled by a conduit, which assembly is pivotally mounted on a horizontal axis. Liquid partially fills the lower chamber above the conduit opening, and an absorber facilitates selective heating of the lower chamber. With sufficient heating, enough liquid is forced into the upper chamber to rotate the device, thereby reversing the positions of the chambers. The cycle repeats. Sunlight provides sufficient energy to rotate exemplary devices at least once every few minutes.

8 Claims, 6 Drawing Sheets

THERMAL- POWERED ROCKING DEVICE

CROSS REFERENCES TO RELATED APPLICATIONS

This application claims the benefit of Provisional Application No. 60/044,787 entitled THERMAL-POWERED ROCKING DEVICE filed by the applicant on Apr. 22, 1997.

FIELD OF THE INVENTION

This invention relates to thermal-powered rocking devices particularly useful as decorative and educational toys.

BACKGROUND OF THE INVENTION

It is well-known that heat can cause a gas to expand and that heat-expanded gas can be used to move a volume of liquid. These phenomena are illustrated by the device of FIG. 1 comprising a pair of closed chambers 101 and 110 coupled by a conduit 106. Chamber 101 includes a liquid 104 extending above the opening of pipe 106 and a thermal radiation absorbing element 102, such as a black metal panel. When thermal radiation such as infrared radiation from the sun 100 strikes panel 102, the panel absorbs radiation and heats the gas in the chamber. The gas expands forcing liquid 104 up pipe 106 into upper chamber 110.

The potential effects of these phenomena can be estimated from the Ideal Gas Law which states:

$$PV=nkT \qquad \text{(Eq. 1)}$$

where P is the pressure, V is the volume, n is the number of molecules in the volume, k is Boltzman's constant, and T is the temperature relative to absolute zero. A quick experiment to estimate the available temperature rise from the sun is to place an aluminum sheet in a sealed clear plastic box. One side of the sheet is shiny aluminum, and the other side is painted flat black. The box is placed in the sun, first exposing the Al side to the light, and then the black side. Naturally, the black side absorbs more sunlight. A temperature difference of 20 to 30° C. in full sun can be measured via a thermocouple inserted through a small hole into the chamber. In a well insulated chamber, higher temperatures are possible, but the insulation also slows losses during cooling.

A 30° C. rise (remembering room temperature is about 300° C. above absolute zero) causes a 10% change in pressure. This 10% pressure change can lift a column of water 10% of 33 feet (33 feet of water is the equivalent of one atmosphere of pressure), or 3.3 feet. On the other hand, the temperature rise can create a 10% volume change. So a 10×10×10 inch heated container can create a volume change of 100 cu in, or roughly 4×4×4 inches.

To see how this heat energy can be used to move a volume of liquid, consider the effect in FIG. 1. Here, sun 100 strikes the black metal sheet 102 in chamber 101. This sheet heats the air in chamber 101, raising the air's temperature by ~10%. The increased air pressure pushes on liquid 104, which is forced through pipe 106 up into the second chamber 110. As long as the height of chamber 110 is less than 3.3 feet above chamber 101, liquid 104 can rise into chamber 110. The liquid will continue to rise until it has increased the volume of chamber 101 containing air by no more than about 10%.

While the device of FIG. 1 illustrates the relevant phenomena, it is a relatively stationary device with limited capacity to amuse or arouse curiosity. Accordingly there is a need for a more dynamic device to exhibit the effects of gas expansion and liquid displacement.

SUMMARY OF THE INVENTION

In accordance with the invention, a solar rocking device comprises a pair of chambers coupled by a conduit, which assembly is pivotally mounted on a horizontal axis. Liquid partially fills the lower chamber above the conduit opening, and an absorber facilitates selective heating of the lower chamber. With sufficient heating, enough liquid is forced into the upper chamber to rotate the device, thereby reversing the positions of the chambers. The cycle repeats. Sunlight provides sufficient energy to rotate exemplary devices at least once every few minutes.

BRIEF SUMMARY OF THE DRAWINGS

The nature, features and advantages of the invention will become clearer by consideration of the exemplary embodiments described in connection with the accompanying drawings. In the drawings.

It is to be understood that these drawings are to illustrate the concepts of the invention and are not to scale.

DETAILED DESCRIPTION

Figure 1:
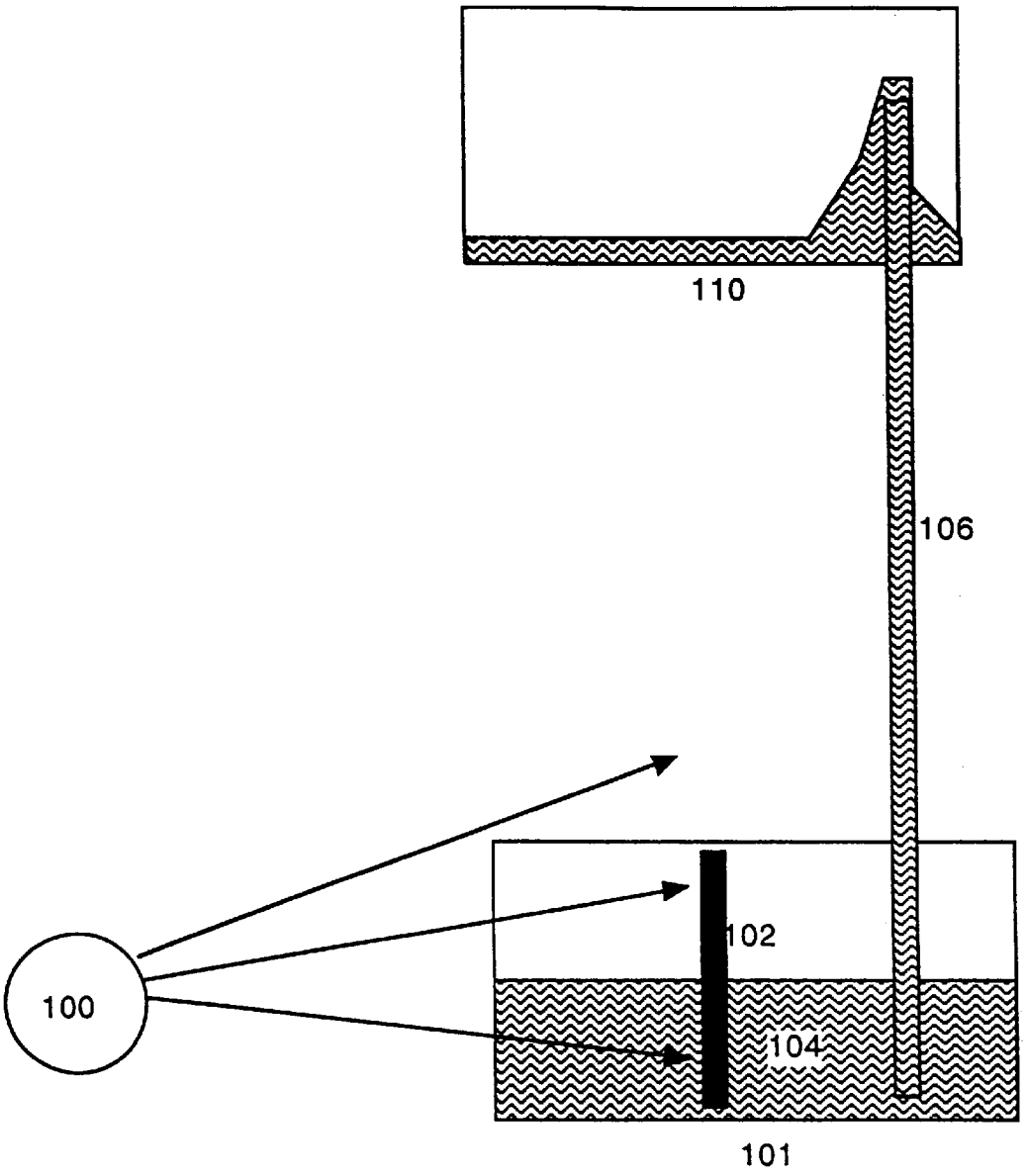
FIG. 1 illustrates a device useful in explaining the phenomena which occur in the invention.

Referring to the drawings, FIG. 1 was described in the Background of the Invention to Illustrate the use of heated gas to displace a liquid.

Figure 2:
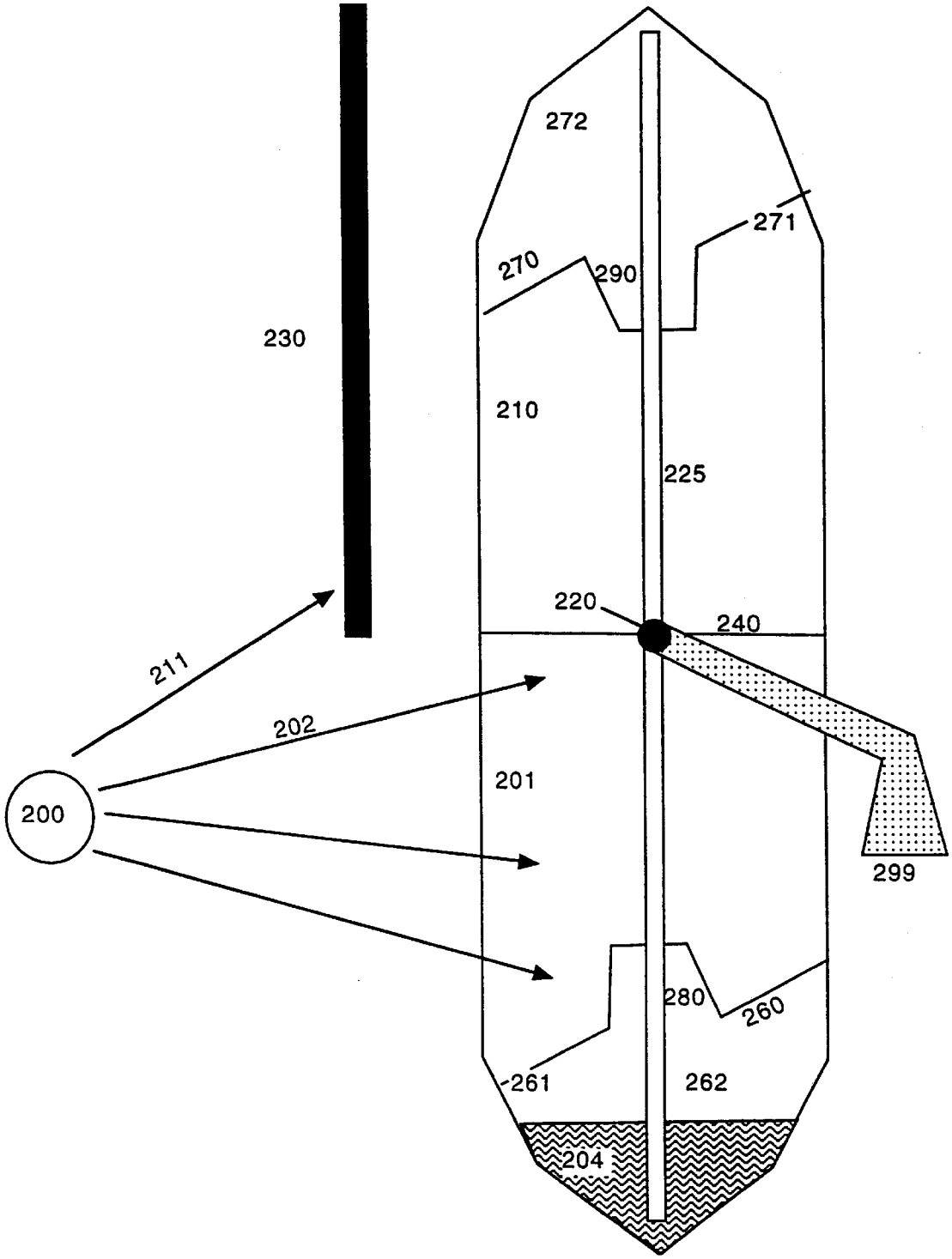
FIG. 2 is a schematic cross section of a first embodiment of a thermal powered rocking device in accordance with the invention.

FIG. 2 is a schematic cross section of a preferred thermal radiation powered rocking device. The device comprises an assembly including a pair of chambers 262 and 272 connected by a conduit 225. It optionally includes walls of optional housing chambers 201 and 210. The assembly is disposed on a support 299 for holding the assembly with one chamber disposed vertically above the other. The assembly is pivotally mounted on the support to pivot freely on a horizontal axle 220, whereby the vertical positions of the two chambers can be reversed. A heat source is provided for selectively heating the lower of the chambers. Specifically, in this embodiment, rays 211 from Sun 200 are blocked by shield 230 from entering chambers 262, 272. But, rays 202 from sun 200 can enter the lower chambers 201, 262. Not shown (for purposes of clarity) is a black metal sheet disposed in chambers 262, 272 (or 201, 210) to absorb the sunlight 200.

Liquid 204, such as mineral oil, rests in the bottom of chamber 262. The volume of oil is chosen consistent with the expected temperature rise—for example, if the temperature rise is about 10%, then the amount of oil might be chosen to occupy 8% of the volume of the chamber.

Chambers 201 and 210 can be separated by wall 240. Tube 225 connects the two chambers 262, 272. Each chamber also contains a sloping wall 260, 270 that nearly seals off the chamber near the end, except for small holes 261, 271, respectively. These small holes permit air pressure from the main heated section of each chamber 201, 210 to act on the oil within respective smaller chambers 262, 272. Sloping walls 260 and 270 are shaped to contain small wells 280, 290 colinear with tube 225.

Figure 3:
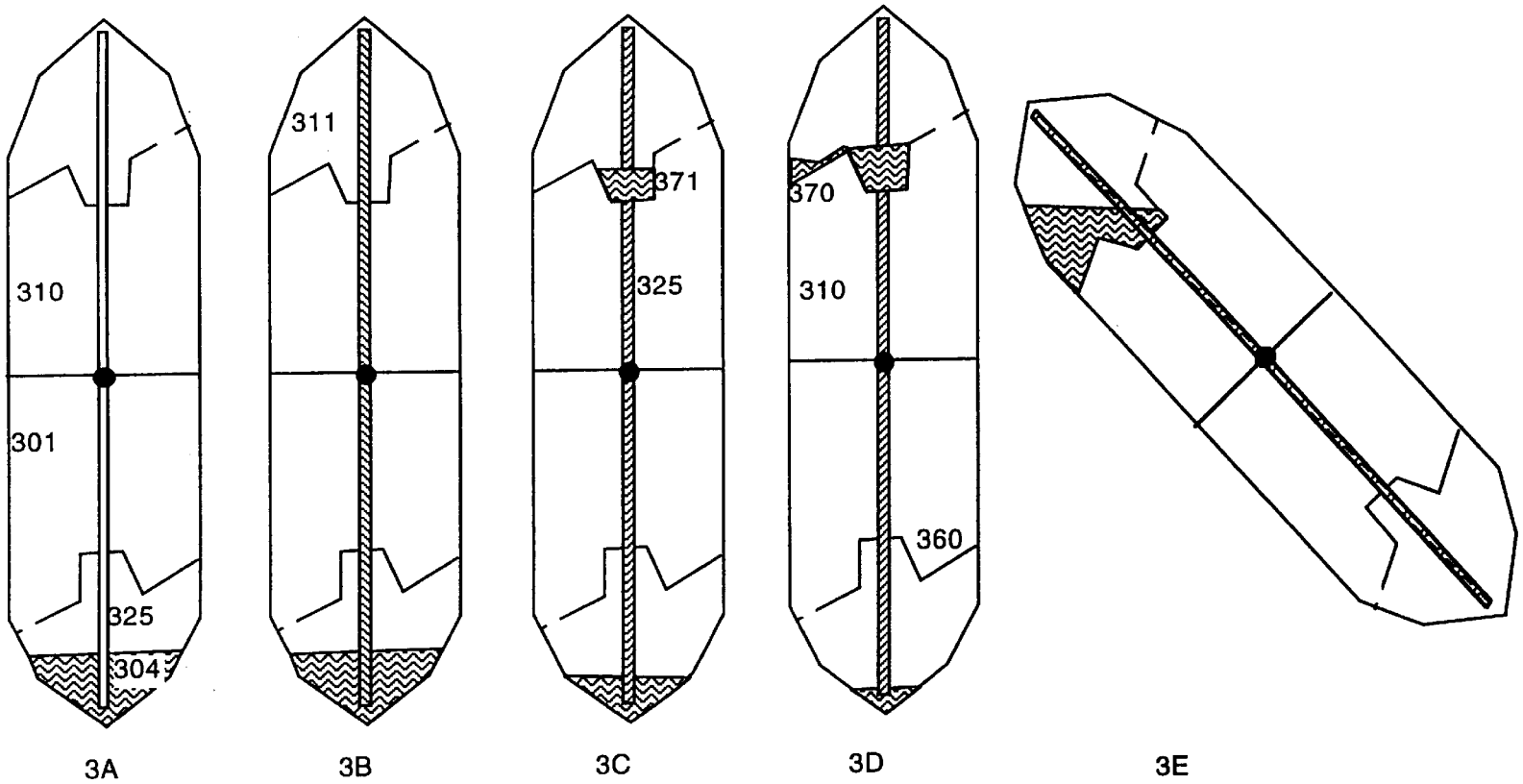
FIGS. 3A–3D show the device of FIG. 2 at various stages of its operation.

FIGS. 3A–3E show the device of FIG. 2 at various stages of operation, starting with FIG. 3A. When light first strikes the black metal sheet in chamber 301 (neither the black sheet nor the light shield, are shown in FIG. 3 for clarity), the heated air forces oil 304 through the bottom of tube 325 up into chamber 311, as shown in FIG. 3B. This oil then drips down the outside of tube 325 and collects in well 371, as shown in FIG. 3C. Because the well 371 is co-linear with tube 325, the entire apparatus remains upright. However, well 371 is designed to contain only about 80% of the oil 304. Once the well is full, the oil subsequently forced from chamber 301 into chamber 311 overflows well 371, drains to the left and is captured between the wall of chamber 311 and the sloping wall 370 as shown in FIG. 3D. This upsets the balance of the device, and the entire apparatus pivots on the axle to the left, as shown in FIG. 3E. The oil then drains to the bottom of chamber 311, and since this chamber is now exposed to the light, the cycle repeats.

One feature of the device is its ability to correct for unusual starting or heating conditions. If for some reason one side is overheated, then once all the oil is shifted from that side, hot air bleeds into the other chamber, restoring equilibrium.

The device is preferably fabricated of high temperature plastic such as polycarbonate. Glass also works well but is more expensive to fabricate. The liquid is preferably a lightweight oil such as mineral oil or a synthetic motor oil. The preferred gas is air.

A number of models made of polystyrene were built along these general lines. Using a 100 W flood lamp to simulate the heat from the sun, and chambers of dimensions 4×4×7 inches, the device worked as described. Cycle times were about 2 minutes. Heat eventually caused the polystyrene to warp, indicating a higher temperature plastic or glass would be a better choice of material.

Figure 4:
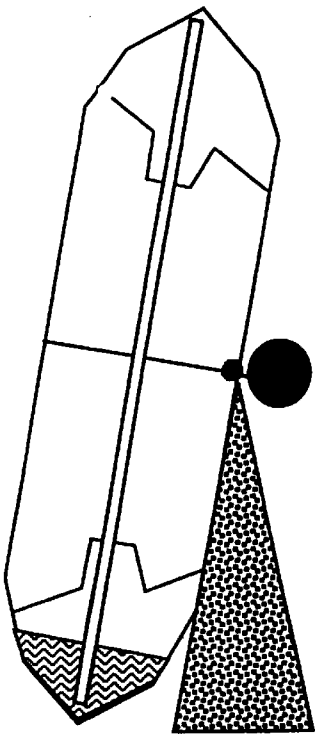
FIG. 4 is a schematic cross section of an alternative embodiment of a rocking device powered by thermal conduction.
Figure 4:
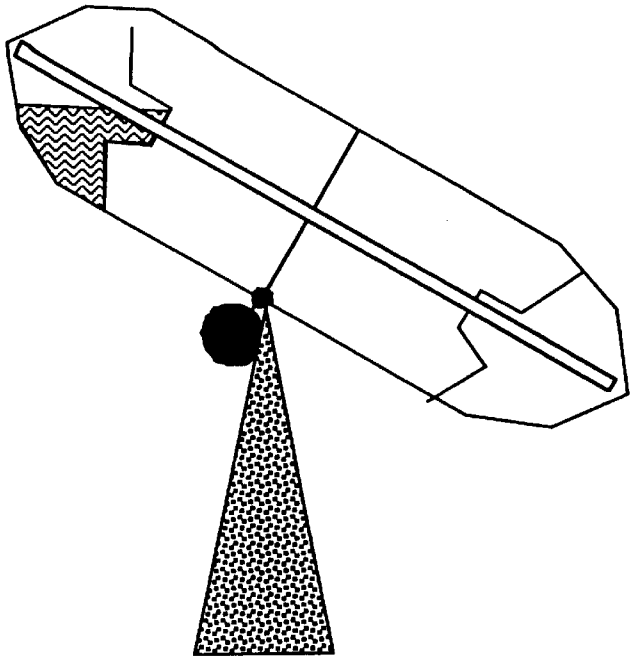
Figure 4:
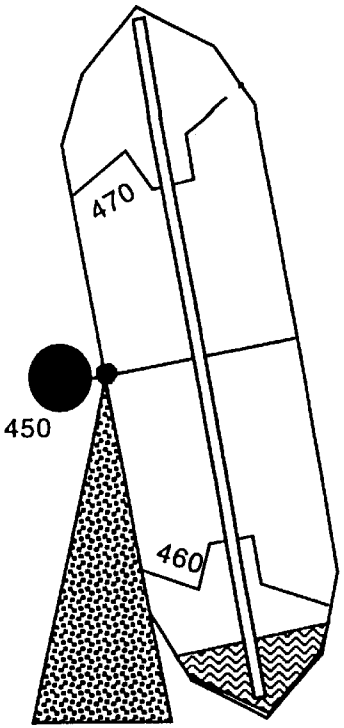

FIGS. 4A, 4B, and 4C illustrate an alternative embodiment of the invention. Instead of thermal radiation, however, this embodiment uses heat captured directly through contact with heat source 499. For example, heat source 499 might be an aluminum block resting on a radiator. The sloped walls 460, 470 point in different relative directions compared to walls 360 and 370 of FIG. 3. In this case, the device rocks back and forth (from one side (FIG. 4A) to the other (FIG. 4C)), rather than always rotating in one direction as in FIG. 3. A counterweight 450 can be added to make sure the small imbalance produced by the moving oil is sufficient to tip the device.

Figure 5:
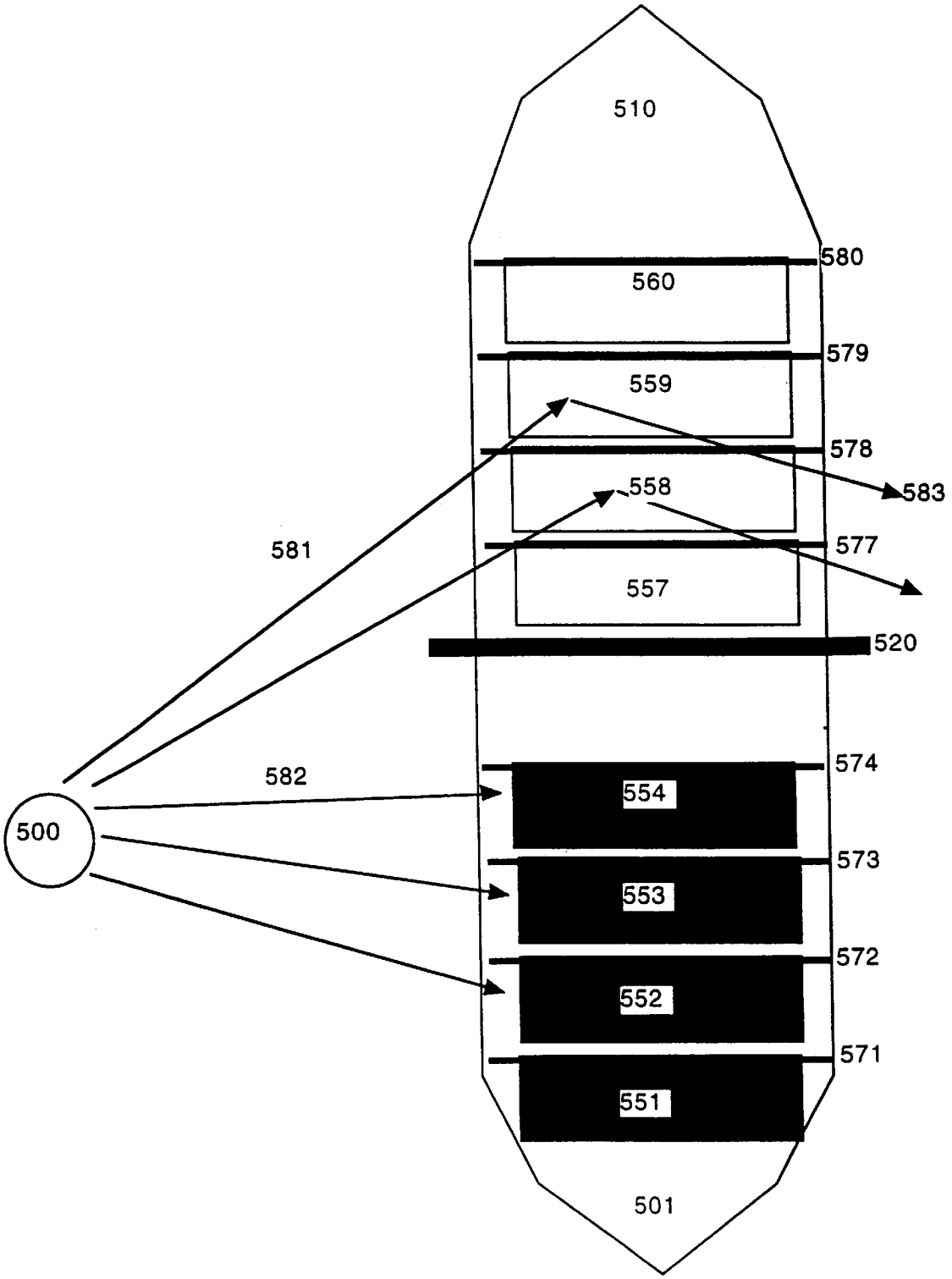
FIG. 5 is a cross section of a third embodiment of a rocking device including an integral radiation shield.

FIG. 5 illustrates a third embodiment of the invention. Rather than using an external shield to prevent light from entering one chamber, a shield with variable solar absorption can be included in each chamber. The absorption of each shield is determined by the position of the chamber with respect to the pull of gravity. A series of flaps 551 to 560 are mounted in the chambers. One side of each flap is painted black, the other side is shiny aluminum. Each flap is attached to an axle 571, 572 etc., and can swing freely under the influence of gravity. The oil and connecting tube system, similar to that of FIG. 3, is not shown for clarity.

The lower chamber 501 is positioned so that the black side of the flaps face the sun. The faces of the flaps in the upper chamber 510 are shiny aluminum. Thus the lower chamber heats, while the upper chamber cools. As the previously described device, oil is forced under pressure from chamber 501 to 510. This tilts the apparatus and rotates it counter-clockwise. As the device rotates, flaps 551 to 560 are reoriented under the influence of the gravity, and the black and aluminum sides of the flaps are interchanged relative to the direction of the sun. Once again the lower chamber contains absorbing black flaps, and the cycle repeats.

This version of the rocker has the advantage of being completely self-contained. The moving flaps provide an additional source of amusement.

Figure 6:
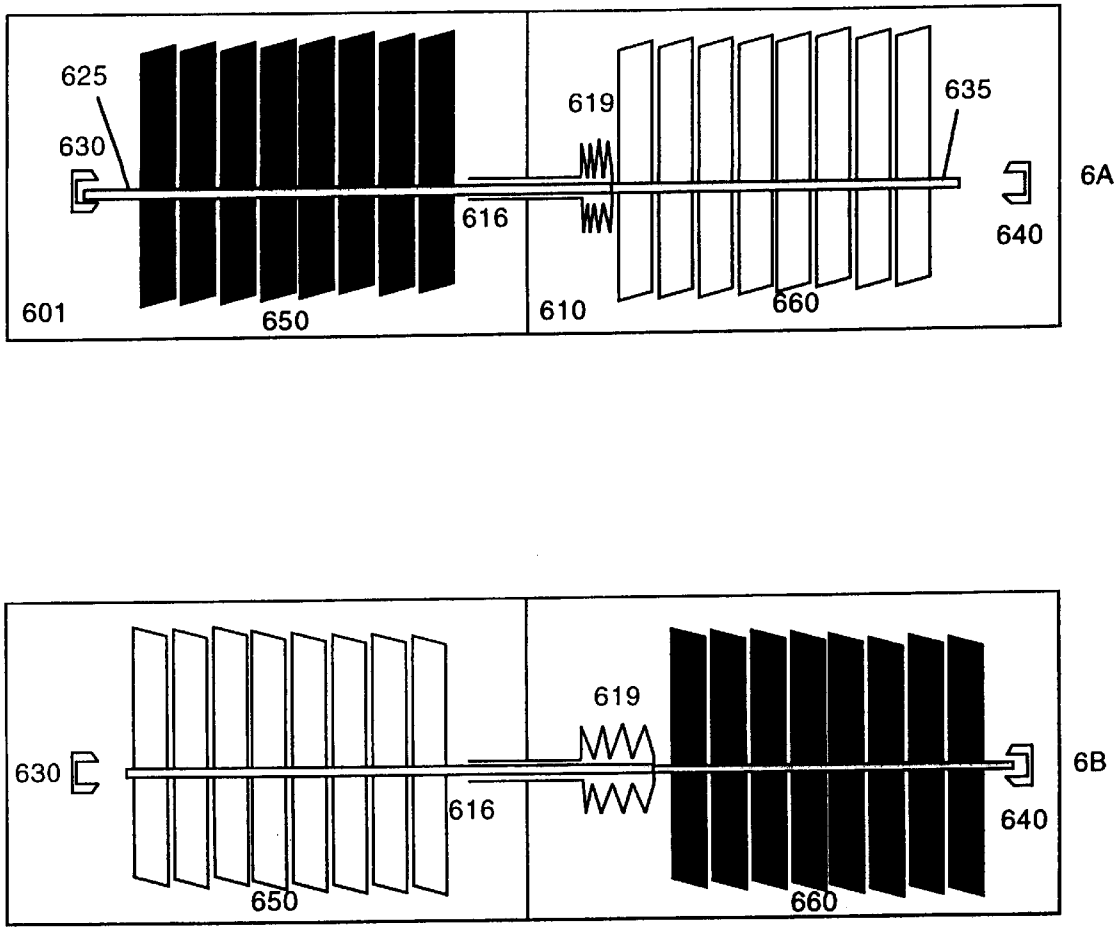
FIGS. 6A and 6B show another embodiment of the invention using radiation blinds.

FIGS. 6A and 6B show another embodiment of the invention. In all the previous examples, a liquid was the moving fluid and the entire apparatus tilted in response to the motion of the oil. In this example, air is the moving fluid and only the flaps are shifted to modulate the light absorption of each chamber in sequence.

Two chambers 601 and 610 are connected via tube 616. One end of the tube is sealed to a flexible plastic bellows 619 and the bellows in turn is attached via linkages 625, 635 to flaps 650, 660 respectively. These bellows are sized to be consistent with the assumed temperature shifts typically 5%–10% of the volume of either chamber.

The flaps are connected to the linkage in parallel—much in the same way Venetian blinds or jalousie porch windows are designed. So, when the bellows 619 is fully compressed, as in FIG. 6A, linkage 625 rotates all flaps in chamber 601 such that the black side faces the sun. The same bellows motion forces linkages 635 to rotate its connected flaps 660 to present a shiny aluminum side to the sun.

Operation is similar to the previous examples. FIG. 6A shows the beginning of the cycle. Chamber 601 is cooler than 610, and thus the higher pressure in 610 compresses bellows 619. This forces the flaps, via attached linkages to present a black surface to the sun in chamber 601, and a shiny surface in chamber 610.

Since chamber 601 contains the black flaps, it absorbs sunlight and heats the surrounding air within the chamber. To prevent bellows 619 from slowly expanding and placing the flaps 650,660 in an "intermediate" position where only the flap edges are presented to the sun, detents 630, 640 can attach to the linkages. These detents may be a mechanical spring and catch, or a small magnet and metal plate. In either case, the detents are designed to restrain the movements of bellows 619 until a desired pressure is reached. At this point detent 630 releases, and bellows 619 expands. This moves linkages 625 and 635 to the right, as in FIG. 6B, and engages detent 640. The motion of linkages 625 and 635, are sufficient to rotate flaps 650, 660 and interchange the black and shiny sides. Then, the cycle repeats with chamber 610 heating, and 601 cooling.

It is to be understood that the above-described embodiments are illustrative of only a few of the many possible specific embodiments which can represent applications of the principles of the invention. For example, the motion of the rocker can be used to ring a bell, turn a pulley and lift a weight, or roll on a set of wheels. Moreover the device can be visually enriched by adding colored or reflective neutrally buoyant particles to the liquid. Thus numerous and varied arrangements can be readily devised by those skilled in the art without departing from the spirit and scope of the invention.

What is claimed:

1. A thermal-powered rocking device comprising:

an assembly including a first chamber, a second chamber, and an open conduit connecting said first chamber to said second chamber;

a support for supporting said assembly with one chamber disposed vertically above the other, said support including a pivotal mount for pivotally mounting said assembly so that upon pivoting the vertical positions of the chambers are reversed;

said first and second chambers including gas, and the lower of said chambers being partially filled with a liquid whereby upon selectively heating the lower of said chambers, the gas therein will expand and force said liquid through the conduit into the upper chamber causing said chambers to pivot to reversed vertical positions; and said first and second chambers each including an absorbing material for absorbing radiation and thereby heating the gas in said chamber; and means for selectively reducing the radiation absorbed by the absorbing material in the chamber in the upper position, whereby radiation will heat the chamber in the upper position less than the chamber in the lower position, causing said first and second chambers to repeatedly change vertical position.

2. The device of claim 1 wherein the means for reducing absorption in the chamber in the upper position comprises a shield for selectively blocking sunlight from the chamber in the upper position while permitting sunlight to heat the chamber in the lower position.

3. The device of claim 1 wherein said absorbing material comprises a solid sheet having an absorbing surface.

4. The device of claim 1 including in said first and separate chambers absorbing material which selectively absorbs more radiation in the lower of said chambers than the upper chamber.

5. A thermal-powered rocking device comprising:

an assembly including a first chamber, a second chamber, and an open conduit connecting said first chamber to said second chamber;

a support for supporting said assembly with one chamber disposed vertically above the other, said support including a pivotal mount for pivotally mounting said assembly so that upon pivoting the vertical positions of the chambers are reversed;

said first and second chambers including gas, and the lower of said chambers being partially filled with a liquid whereby upon selectively heating the lower of said chambers, the gas therein will expand and force said liquid through the conduit into the upper chamber causing said chambers to pivot to reversed vertical positions; and said first and second chambers each including a rotatable flag having an absorbing surface on one side and a reflecting surface on the other, said flags positioned and arranged for exposing the absorbing surface to radiation in the lower position while exposing the reflecting surface to the radiation in the upper position.

6. The device of claim 5 wherein at least one of said chambers includes a bellows responsive to the difference in gas pressure between said first and second chambers for rotating said flags.

7. A thermal-powered rocking device comprising:

an assembly including a first chamber, a second chamber, and an open conduit connecting said first chamber to said second chamber;

a support for supporting said assembly with one chamber disposed vertically above the other, said support including a pivotal mount for pivotally mounting said assembly so that upon pivoting the vertical positions of the chambers are reversed;

said first and second chambers including gas, and the lower of said chamber being partially filled with a liquid whereby upon selectively heating the lower of said chambers, the gas therein will expand and force said liquid through the conduit into the upper chamber causing said chambers to pivot to reversed vertical positions; and a heat source positioned for contacting the chamber in the lower position to conductively heat the chamber in the lower position.

8. The device of claim 1 wherein the gas is air.

* * * * *